US005326279A

United States Patent [19]

Sumida

[11] Patent Number: 5,326,279

[45] Date of Patent: Jul. 5, 1994

[54] COMBINATION CONNECTOR ASSEMBLY

[75] Inventor: Tatsuya Sumida, Yokkaichi, Japan

[73] Assignee: Sumitomo Wiring Systems Ltd., Yokkaichi, Japan

[21] Appl. No.: 997,561

[22] Filed: Dec. 28, 1992

[30] Foreign Application Priority Data

Dec. 27, 1991 [JP] Japan ..... 3-108020

[51] Int. Cl.[5] ..... H01R 13/60

[52] U.S. Cl. ..... 439/540; 439/157

[58] Field of Search ..... 439/152-160, 439/372, 709, 715-717, 368, 540

[56] References Cited

U.S. PATENT DOCUMENTS

| | | | |
|---|---|---|---|
| 2,535,031 | 12/1950 | Beatty . | |
| 2,939,103 | 5/1960 | Agron et al. | 439/157 |
| 3,300,751 | 1/1967 | Fraley | 439/372 |
| 3,345,604 | 10/1967 | Henschen et al. . | |
| 3,534,320 | 10/1970 | Rushing | 439/157 |
| 4,780,090 | 10/1988 | Sugiyama et al. . | |
| 4,923,310 | 5/1990 | Sakiguchi et al. | 439/540 |

FOREIGN PATENT DOCUMENTS

| | | |
|---|---|---|
| 0459448 | 12/1991 | European Pat. Off. . |
| 1515906 | 3/1970 | Fed. Rep. of Germany . |
| 1517332 | 3/1967 | France . |
| 320880 | 2/1991 | Japan . |
| 2179506A | 3/1987 | United Kingdom . |

*Primary Examiner*—David L. Pirlot

*Attorney, Agent, or Firm*—Sughrue, Mion, Zinn, Macpeak & Seas

[57] ABSTRACT

A pair of holding members are provided for removably holding female and/or male connectors in plurality therein. A cover is removably attached to the second holding member on the wire fitting side, the cover (8) being provided with a hold-down portion. Respective one ends of the connectors held in one of the holding members are urged toward the other holding member by means of the hold-down portion. The one holding member (6) has a pin formed thereon for lockingly engage a cam groove. A lever formed with the cam groove is rotatably provided on the other holding member. The lever is rotated while the pin is in engagement with the cam groove, whereby plural pairs of connectors held in position within respective holding members are coupled together in one operation.

3 Claims, 4 Drawing Sheets

COMBINATION CONNECTOR ASSEMBLY

BACKGROUND OF THE INVENTION

1. Field of the Invention

The present invention relates to a combination connector assembly having plural pairs of female and male connectors arranged for engagement together, and more particularly to a connector assembly of a type such that a plurality of female connectors each individually formed as a single element, as held in position in one holding member, can be accurately brought in engagement with male connectors, which can be advantageously applied for use in an automotive wiring harness or, in particular, in an electronic unit.

2. Description of the Prior Art

Recently, as electronic components increasingly develops in automobile technology, the number of wiring harness circuits tends to increase and accordingly the number of connectors used in wiring harnesses is steadily increasing. However, the greater the number of wiring harnesses attached to one connector increases, the greater the coupling load develops when male and female connectors are engaged together, resulting in some operational troubles. Another problem is that coupled connectors are likely become half-engaged, which results in a trouble such that electronic components connected through wiring harnesses become inoperative.

As may be appreciated from the above, whereas provision of a large number of terminal receiving chambers in one connector for coupling a large number of wiring harnesses is likely to result in various troubles, decrement in the coupling capacity of one connector necessitates male-female engagement of a large number of connectors which operation is very troublesome. Further, in the latter case, it is necessary to provide a holding mechanism for each connector. This involves considerable complexity in the arrangement of connector setting and greater space therefor, which poses a serious problem especially where connectors are to be set in an electronic unit which requires highly dense and collective arrangement of components.

These problems may be solved by arranging in such a manner that a plurality of connectors, each consisting of a single element having a reduced degree of coupling number, as being held in one holding member, can be brought into engagement in one operation with a plurality of connectors which are similarly held in one holding member.

Through this arrangement it is possible to decrease the number of operations involved and also to solve the problem of greater space requirement.

Such arrangement as mentioned above has already been proposed as disclosed in, for example, the Japanese Utility Model Application Laid-Open No. 3-20880.

In the conventional connector assembly proposed in the above publication, a plurality of first connectors are held in a plurality of connector holding portions recessed in a first connector cover while second connectors are similarly held in a plurality of connector holding portions recessed in a second connector cover, where the plural pairs of first and second connectors are fixed together in their mating condition by tightening a clamping bolt which extends through a bolt hole bored in the first connector cover to a bolt guide portions formed in the second connector cover.

However, the above described connector has disadvantages that the adoption of a bolt clamping system involves various fastening parts, such as bolts, washers, and push nuts, which results in increased number of parts and, in turn, increased cost of fabrication. Moreover, since the fastening parts are separated from the connectors, parts management is required with respect to those parts. Further, because of the fact that the fastening parts are composed of metallic parts, the weight of the connector assembly is increased.

Another problem is that the arrangement involves considerable clamping load because connector covers each holding a plurality of connectors are fastened together. This requires a special clamping device, such as an impact device, which involves a considerable complexity in operation.

A further problem is that when clamping is effected by means of such an impact device, considerable impact is applied on the connectors, and more particularly where the connectors come into engagement with a unit component carrying a computer or the like, the impact is transmitted to the unit component with the result that the soldered portions and/or elements of the unit component may be unfavorably affected.

Furthermore, in the conventional connector assembly referred to above, each connector has a very large number of poles, which fact often leads to erroneous terminal setting at the time of assembly of a wiring harness.

SUMMARY OF THE INVENTION

The present invention is directed to eliminating the foregoing problems of the prior art, and therefore it is an essential object of the present invention to provide a combination connector assembly which enables simple and accurate coupling and fixing of male and female connectors by manual operation without resorting to the method of fixing by bolt clamping which requires the use of an impact device, and thus to protect electronic units from impact possibilities arising in the use of the impact device.

Another object of the present invention is to provide a combination connector assembly in which the number of parts associated with coupling and fixing work is decreased, eliminates separate parts or limit the number of such parts to only one if necessary at all, in order to facilitate parts management and provide for cost and weight reduction.

It is a further object of the present invention to provide a combination connector assembly in which the number of poles is decreased with respect to each of individual single connectors used in combination so as to reduce possible terminal setting errors and improve degree of freedom on design of wiring harnesses.

Therefore, according to the present invention there is provided a combination connector assembly having interengageable male and female connector units adapted for simultaneous engagement in such a condition that plural pairs of connectors are held in position, where the combination connector assembly comprises a pair of holding members for removably holding the same number of female and/or male connectors in a plural number, a cover mounted to one of the holding members on the electric wire receiving side thereof, a hold-down portion projecting from the cover such that connectors primarily held within the interior of the holding member are secondarily held in position by the hold-down portion, a lever formed with a cam groove and pivotally attached to one of the holding members or to the cover mounted to the one holding member, and a pin projecting from the other holding member or from the cover mounted to the other holding member for being lockingly received in the cam groove, whereby a pivotal manipulation of the lever with the pin brought into engagement with the cam groove permits simultaneous engagement of the plural pairs of connectors held in the two holding members and, at the same time, coupling of the holding members to each other.

More specifically, the combination connector assembly may be, for example, of such arrangement that the connector units (7) each adapted as a wiring-harness connecting connector having the same configuration are removably fitted in position in the holding member (6), with their rear ends pressed by means of the cover toward the other holding member (1), and wherein the other connector units (2) each adapted as a printed board connecting connector are held in the holding member(1) serving as a connector housing having therein the connector units (2) integrally formed therewith for receiving tabs projecting from the printed board, where the lever is mounted in position on the connector housing side, the holding member (6) being provided with a pin projecting therefrom for locking the lever.

According to another feature of the invention, the combination connector assembly may be such arrangement that the cover comprises a frame portion composed of a rectangular frame member and a lid portion connected to the frame portion through a hinge portion, where the frame portion includes a hold-down portion formed in the interior thereof and a projection formed on the outer periphery thereof, the lid portion having a locking arm engageable with the projection, one opening of the frame portion being closable by the lid portion.

It is preferred that the holding members, the connector housing, and the lever be formed of a light-weight material, such as resin.

According to the above described arrangement of the combination connector assembly of the present invention, male and female connector engagement is performed by pivotally rotating a lever and, therefore, it is possible to couple the connectors by applying small rotational force and thus to prevent shock occurrence at the time of coupling the connectors.

As above described, the connectors are primarily held within the holding member and further securely held in place by means of the hold-down portion provided in the cover. This positively prevents connectors from slipping out of place at the time of male and female connector engagement. Even when connectors are not securely held by the primary locking portion provided in the holding member, the connectors can be positively forced into the holding member by mounting the cover to the holding member thereby to be locked in position by the primary locking portion.

Further, where the cover comprises a frame portion and a lid portion as described above, it is possible to visually determine by releasing the lid portion whether the connectors are positively held in the holding member and that, at the time of cover fitting, wires are not caught in between the cover and the holding member.

In the present invention, the lever and pin are formed integrally with the holding member and, therefore, provision of any separate parts is not required. Further, by arranging that the lever and pin as well as the holding member are formed of a light-weight resin material, it is possible to prevent any substantial increase in the weight and size of assembly due to the provision of the lever and the like.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The present invention will now be described in further detail with respect to embodiments thereof with reference to the attached drawings.

FIGS. 1 through 4 illustrate a first embodiment of the invention which is designed for coupling a wiring harness connector unit (7) to a printed board connector unit (2).

Figure 2:
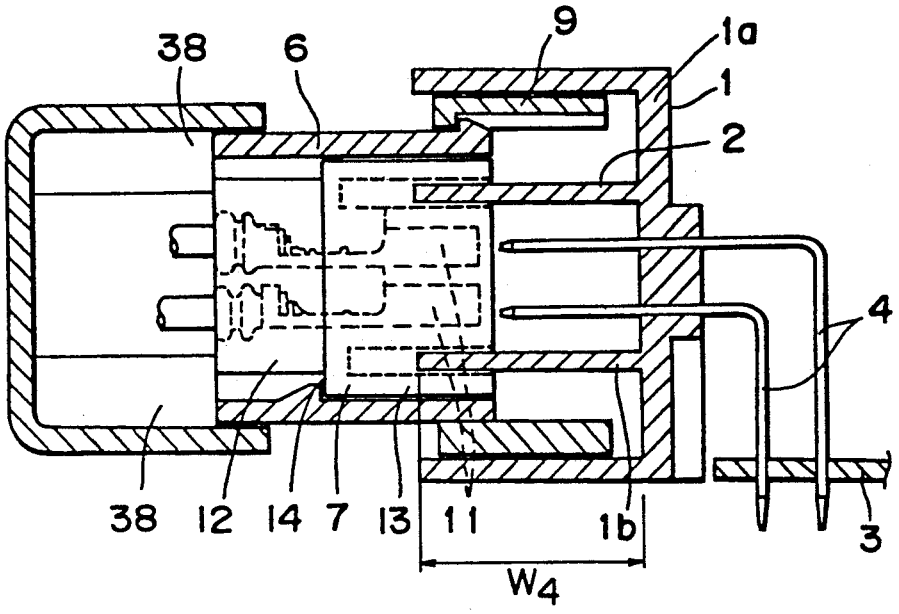
FIG. 2 is a section taken along the line II—II in FIG. 1 as viewed at a tentatively locked position in the first embodiment.
Figure 3:
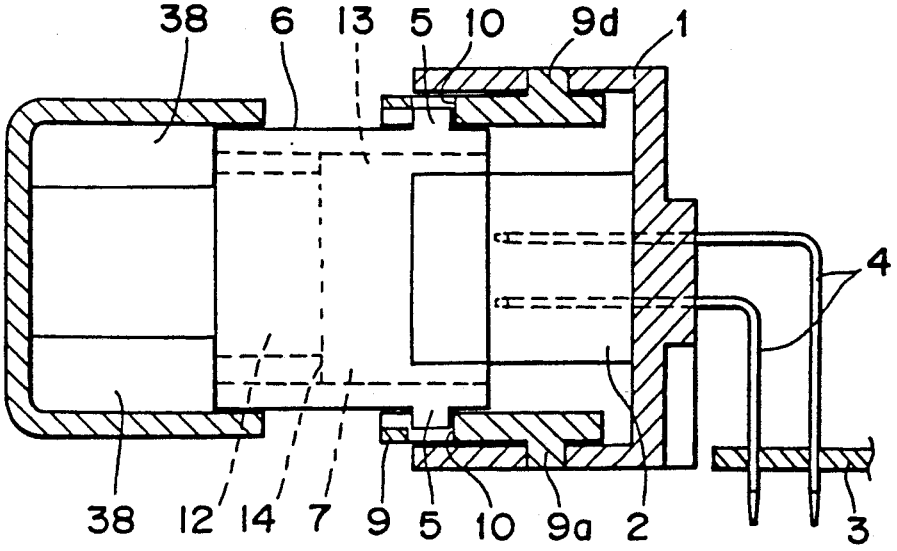
FIG. 3 is a section taken along the line III—III in FIG. 1 as viewed at a tentatively locked position in the first embodiment.
Figure 4:
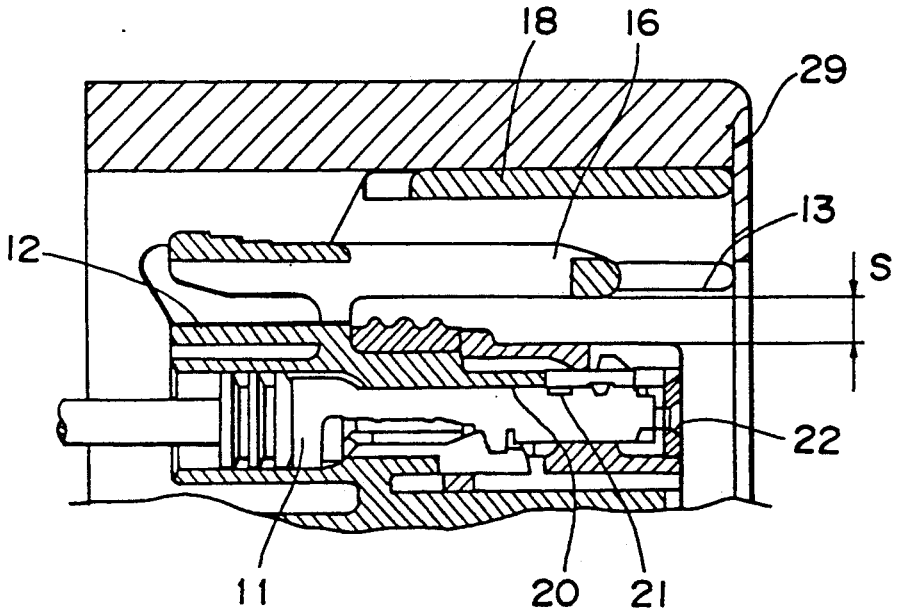
FIG. 4 is a sectional view showing an essential portion of a female connector as held in position in a holding member.

As shown in FIGS. 3 and 4, in the printed board connector side, a male connector housing 1 has a plurality of connector sections 2 serving as terminal receiving chambers arranged side by side, where each connector section receives male tabs 4 extending from a printed board 3 (see FIGS. 2 and 3). In this embodiment, the connector housing 1 per se serves concurrently as a holding member for holding the male connectors 2.

Figure 1:
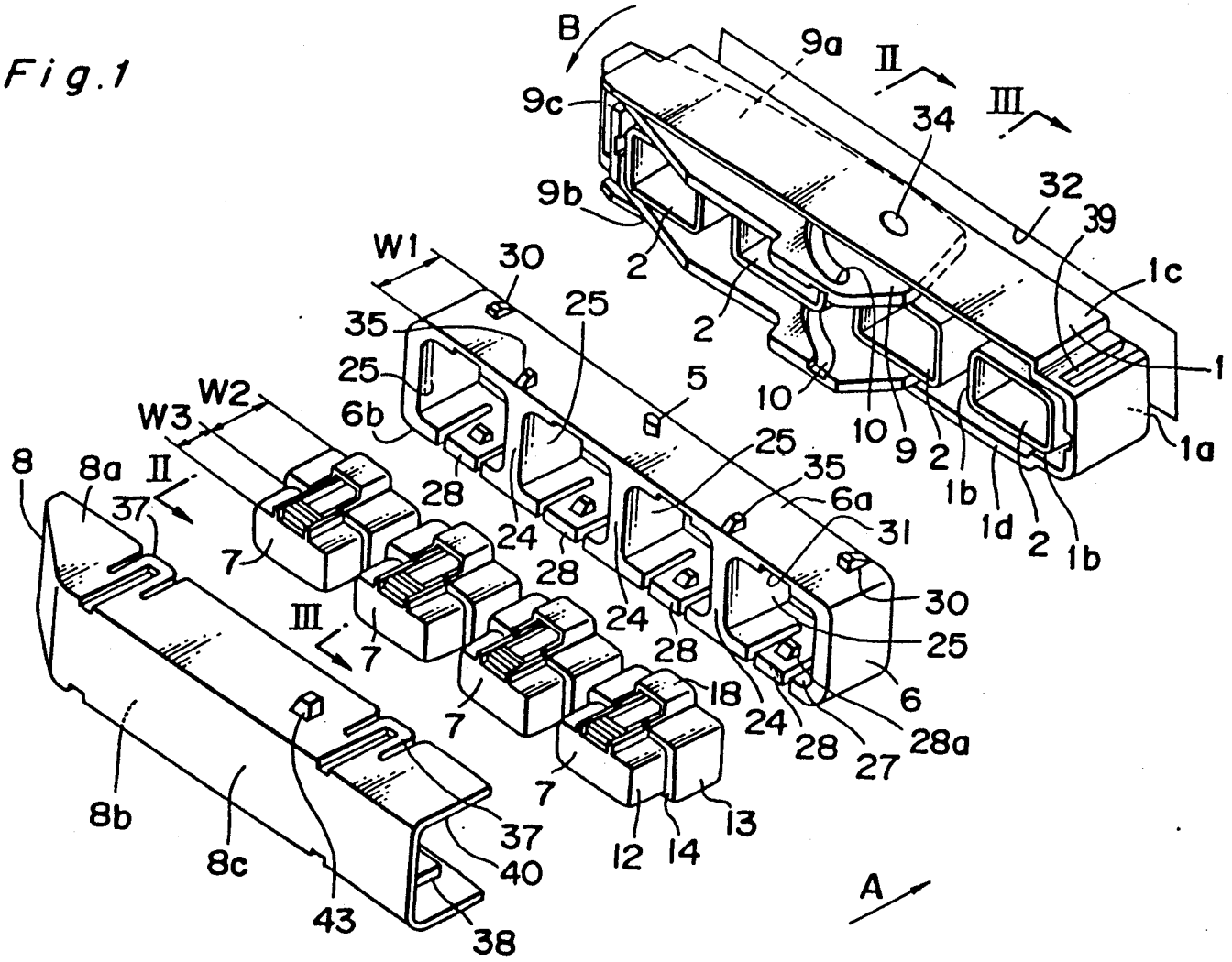
FIG. 1 is an exploded view in perspective showing a first embodiment of the present invention.

In the first embodiment, as shown in FIG. 1, a plurality of female connectors 7 for connecting wiring harnesses are held in place in a holding member 6. The holding member 6 has a pin 5 projected therefrom, and a cover 8 for preventing the female connectors 7 from slipping off when the cover 8 is removably mounted to the holding member 6. The male connector housing 1 which serves concurrently as a holding member is provided with a lever 9 having a cam groove 10 formed therein. The cam groove 10 is lockingly engaged by the pin 5 projecting from the holding member 6. With this engaged arrangement between the pin 5 and the cam groove 10, by turning the lever 9, the plurality of female connectors 7 held in the holding member 6 can be respectively fitted in one operation into the connector sections 2 defined in the male connector housing 1 so that the male tabs 4 are engaged and connected with terminals 11 provided in the respective female connectors 7.

Nextly, the construction of the foregoing components will be described in detail.

Each of the female connectors 7 is provided with female terminals 11 which respectively match circuit current values. The female connectors 7 are each contoured like a structure having larger and smaller two-level rectangular frames arranged in continuation. More specifically, each female connector 7 has a smaller frame 12 positioned on the wire fitting side and a larger frame 13 positioned on the connector coupling side, with a locking stepped portion 14 formed around the peripheral edge portion between the smaller and larger frames 12 and 13 in each connector 7. The locking stepped portion 14 is adapted to be lockingly engaged by a protrusion 28*a* formed on a resilient locking piece 28 provided in the holding member 6 as to be described hereinafter, so that each of the respective female connectors 7 can be held in position within the holding member 6.

On the top of the connector coupling side frame 13 is provided a locking arm 16 (see FIG. 4) formed integrally therewith, and on the top of the arm 16 there is provided a lock protection wall 18 projecting in a U-shape pattern.

The connector coupling side frame 13 constitutes an outer wall of the female connector 7, and in the interior of the frame 13 there is formed an inner frame 21 defining a terminal housing chamber 20, with a space S for coupling a male connector 2 therewith. The terminal housing chamber 20 extends integrally with the wire fitting side frame 12 and the inner frame 21 is formed in continuation with the terminal housing chamber 20.

In the first embodiment, the interior of each frame 12 and inner frame 21 defines a plurality of two-level terminal housing chambers 20, upper and lower (two chambers for each level) in which are disposed four terminals in all for wire connection. Each of the terminal housing chambers 20 has an opening on the wire fitting side and has, on the connector coupling side, a through-hole 22 for male tab insertion.

The holding member 6 in which four female connectors 7 are housed and held in position consists of a rectangular frame which is longitudinally elongate and is open on both the front and rear sides, and has, in its interior, longitudinally equidistantly spaced partition walls 24 formed integrally therewith which define four connector holding chambers 25 arranged in parallel.

Each connector holding chamber 25 has, at its bottom 27, a resilient piece 28 oriented toward corresponding female connector 7, and the resilient piece 28 has a protrusion 28*a* formed on its inner upper portion. Therefore, when the female connector 7 is pushed forward in a forward direction shown by an arrow A in FIG. 1, the connector coupling side larger frame 13 thereof rides over the resilient locking piece 28 for entry into the connector holding chamber 25 until the protrusion 28*a* on the resilient locking piece 28 lockingly engages the locking stepped portion 14 at the border between the larger frame 13 and the wire fitting side smaller frame 12, so that the female connector 7 is primarily held in position within the connector holding chamber 25 defined in the holding member 6, as being prevented from slipping off the holding member 6.

Further, the holding member 6 has a front stop wall 29 for preventing the female connectors 7 from frontwardly sliding off.

The ceiling of each connector holding chamber 25 is recessed to form a groove 31 for receiving a lock protection wall 18 formed on the top of each corresponding female connector 7.

The transverse width W1 of the holding member 6 is set generally equal to the sum of the width W2 of the connector coupling side frame 13 and the width W3 of the wire fitting side frame 12 of each female connector (W1=W2+W3) so that each female connector 7 can be completely housed in the interior of respective connector holding chambers 25 of the holding member 6.

The holding member 6 has upper and lower wall portions 6*a*, 6*b* each having a protrusion pin 5 outwardly protruded on the center portion of the outer side thereof, the pins 5 being releasably engageable with cam grooves 10 of the lever 9 provided in the male connector housing 1 which will be described hereinafter.

The upper and lower wall portions 6*a*, 6*b* are provided at locations close to the cover 8 with a pair of protrusions 35 for locking the cover 8. Further, the upper wall portion 6*a* is formed at locations closer to the male connector housing 1 with a pair of protrusions 30 for tentatively locking the male connector housing 1.

Male connectors 2 which are to mate with the female connectors 7 held in the holding member 6 are formed integrally with one male connector housing 1 which serves concurrently as a holding member as mentioned before. More specifically, the male connector housing 1 has, at the rear side of a planar vertical wall portion 1*a* thereof, four cylindrical frames 1*b*, each having a rectangular shape in section, which are formed integrally therewith and arranged at predetermined intervals, the cylindrical frames 1*b* each being open at the rear side and closed at front and lateral sides to form a connector section 2 in the form of a box-shaped housing.

The four connector sections 2 arranged in parallel in the male connector housing 1 as above described are each so sized as to be engageably fitted in the space S between the outer frame of the connector coupling side frame 13 of the female connector 7 held in corresponding connector holding chamber 25 of the holding member 6 and the inner frame 20 of the frame 13. The width W4 (see FIG. of a projecting portion of each connector section 2 is sized generally equal to the width W2 of the connector coupling side frame 13 of corresponding female connector 7. The upper wall portion of the connector housing 1 is formed with a slit 39.

The frontside of the vertical wall portion 1*a* of the male connector housing 1 is secured to a unit for housing the printed board 3 (only an opening 32 of the unit is shown in FIG. 1). The male tabs 4 connected to the circuitry of the printed board 3 housed in the unit are projected through the vertical wall portion 1*a* into each of the four connector sections 2, as shown in FIGS. 2 and 3. In the first embodiment, each female connector 7 is quadripolar and, therefore, four male tabs 4 are projected into each connector section 2 in four directions. The number of terminals in each female connector 7 is variable and accordingly the number of connecting male tabs 4 is variable as well.

The lever 9 to be attached to the holding member 6 is U-shaped such that upper and lower frame portions 9*a*, 9*b* thereof are disposed respectively in spaces defined between inner sides of upper and lower wall portions 1*c*, 1*d* of the male connector housing 1 and the cylindrical frame 1*b* of the connector sections 2, the upper and lower frame portions 9*a*, 9*b* being interconnected at one end by a bar-like vertical frame portion 9*c*. The upper and lower frame portions 9*a*, 9*b* are provided at the other end with a pin-shaped turning shaft 9*d* extending therethrough which is loosely fitted in a shaft hole 34 formed centrally through the upper and lower walls 1*c*, 1*d* of the male connector 1 so that the lever 9 is rotatable about the turning shaft 9*d*. The upper and lower frame portions 9*a*, 9*b* are each formed with a generally semi-annular cam groove 10 located around the turning shaft 9*d*.

In the first embodiment, there is provided a cover 8 for preventing slip-off of female connectors 7 held in the holding member 6. The cover 8 has upper and lower frames 8*a*, 8*b* and a rear frame 8*c*, which is U-shaped in section with front side open. The upper and lower frames 8*a*, 8*b* of the cover 8 are each provided with a pair of locking arms 37 projecting forward which are lockingly engageable with corresponding protrusions 35 of the holding member 6 to fix the cover 8 with the holding member 6

On the inner side of the rear frame 8*c* and at a portion opposite to the female connectors 7 there is formed a hold-down portion 38 adapted to abut upper and lower surface portions of the wire fitting side frame portions 12 of the female connectors 7 so as to secondarily hold the female connectors 7 when held within the holding member 6. At one end of the cover 8 as viewed longitudinally thereof, there is provided an opening 40 which serves as a drawing port of wires connected to individual female connectors 7.

Nextly, the manner of assembling operation for the above described combination connector assembly will be explained.

The four female connectors 7 are first inserted into respective connector holding chambers 25 of the member 6 and the protrusion 28*a* formed on the resilient locking pieces 28 are brought into engagement with the corresponding locking stepped portions 14. Then, the cover 8 is attached to the rear portion of the holding member 6 and locked in position by causing the locking arms 37 to be engaged with the protrusions 35. Thus, the female connectors 7 are held in engagement with the resilient locking pieces 28 and, in addition, pressed at the rear side by the hold-down portion 38, so that the female connectors 7 are securely held in position within the connector holding chambers 25.

Nextly, the holding member 6 is moved toward the rear side of the male connector housing 1 and, as shown in FIGS. 2 and 3, the four connector sections 2 are inserted into the corresponding openings located in front of the holding member 6. The cylindrical frames 1*b* which constitute housings for respective connector sections 2 are fitted into spaces S between individual female connectors 7, and the projections 30 of the holding member 6 come into locking engagement with slits 39 of the male connector housing 1. In this tentatively locked state, the male tabs 4 are positioned at inlet ends of the through-holes 22 for male tabs which are open at respective rear ends of female connectors 7. At this time, the pin 5 of the holding member 6 is located at the rear end of the cam groove 10 for the lever 9 mounted to the male connector housing 1.

Subsequently, the lever 9 is manipulated to start turning in the direction shown by the arrow B in FIG. 1. Through the removable rotation of the lever 9, the pin 5 moves along the cam groove 10 to move the holding member 6 toward the male connector housing 1. As a result, the holding member 6 moves from its position as shown in FIGS. 2 and 3 further rightward in the figures so that male tabs 4 are allowed to pass through the through-holes 22 of female connectors 7 for entry into the interior of female terminals 11, electrical connection being thus established. At the time when the male tabs 4 are completely fitted into the female terminals 11, the connector coupling side frame portions 12 of the female connectors 7 come into the state of mating with the cylindrical frames 1*b* of the connector sections 2.

As described above, the female connectors 7 go into engagement with the resilient pieces 28 thereby to be primarily held in position within the holding member 6 and, in addition, the female connectors 7 are pressed, at their rear end side, against the forward stop wall 29 by the hold-down portion 38 of the cover 8, whereby they are secondarily held in position. Therefore, even when the female connectors 7 are not held in position by means of the resilient pieces 28, they can be positively forced into the holding member 6 by mounting the cover 8 to the holding member 6, being thus brought into engagement with the resilient pieces 28. When the female connectors 7 are engaged in the connector sections 2, it is unlikely that they become tilted to go out of alignment, it being thus possible to achieve precise male-female connector coupling.

At the end of coupling operation, locking stepped portions (not shown) provided at the inner side of the upper and lower frame portions 9*a*, 9*b* of the lever 9 go into engagement with locking projections 43 formed on the cover 8 thereby to fix the lever 9.

In the first embodiment, the male connector housing 1 fixed to the electronic unit is provided with a lever 9. As stated above, therefore, once the male and female connectors are coupled to securely fix the lever 9, there is no possibility of the lever 9 being caused to move by any external force acting on wires.

Figure 5:
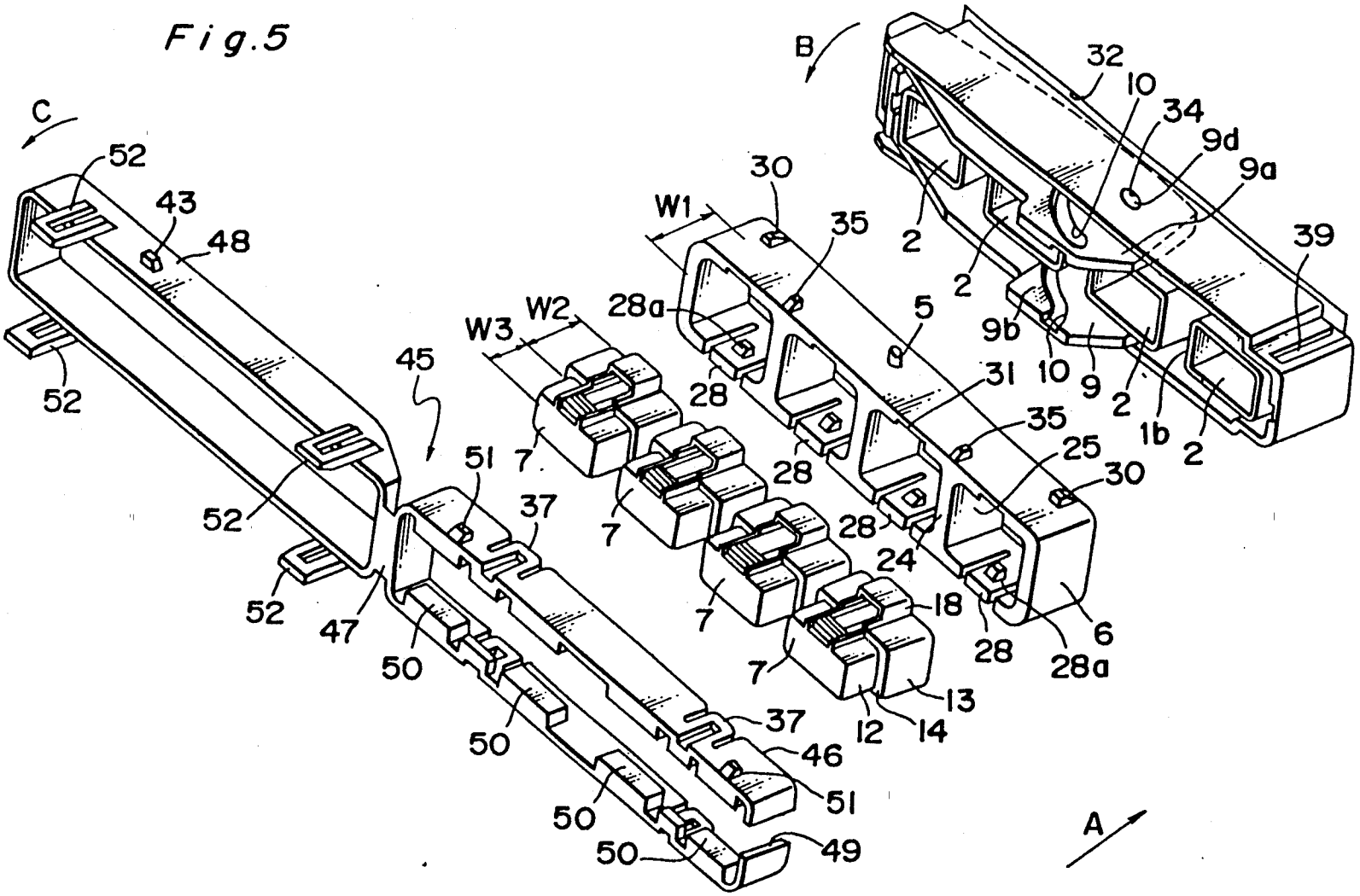
FIG. 5 is an exploded view in perspective showing a second embodiment of the present invention.

Nextly, a second embodiment of the present invention will be described with reference to FIG. 5.

In this second embodiment, a cover 45 includes a frame portion 46, and a lid portion 48 connected with the frame portion 46 through a hinge portion 47.

The frame portion 46 is a longitudinally elongate rectangular frame which has openings at its both front and rear sides. The frame portion 46 has also an opening 49 at one longitudinal end through which wires connected to female terminals 11 can be drawn. In the frame portion 46 there are provided rectangular pusher portions 50 positioned to oppose female connectors 7 such that the pusher portions 50 are pressed against the rear ends of the female connectors 7. Further, upper and lower portions of the frame portion 46 are each formed with a pair of projections 51 engageable with locking arms 52 provided on the lid portion 48.

In assembling the combination connector of this second embodiment, the female connectors 7 are first held in the holding member 6, and then the locking arms 37 on the frame portion 46 of the cover 45 are brought into engagement with the projections 35 of the holding member 6 so as to attach the frame portion 46 to the holding member 6. In this condition, wires of female terminals 11 provided at individual female connectors 7 are drawn through the side opening 49 of the frame portion 46. At this time, it is possible to determine whether the female connectors 7 are precisely held in position within the holding member 6. Then, the lid portion 48 is rotated at hinge 47 to cause the locking arms 52 to engage the projections 51 thereby to close the rear side opening of the frame portion 46, as shown by an arrow C in FIG. 5. Thereafter, in same manner as in the first embodiment, the male connector housing 1 is coupled to the female connectors 7 held in the holding member 6.

In the second embodiment, as described above, female connectors 7 can be visually confirmed with the cover 45 attached to the holding member 6. This provides for accurate coupling of female connectors 7 to the male connector housing 1 and easy operation of wire drawing from the opening 49.

Other features and functions of the second embodiment are identical with those of the first embodiment and, therefore, description thereof is omitted, it being only noted that identical members are designated by identical reference numerals.

The scope of the present invention is not limited to the foregoing embodiments, and the construction of the device may modified in various ways.

For example, the lever may be attached to the holding member or the cover, and the pin to be received in the cam grooves of the lever may be provided at the male connector housing side.

In the foregoing embodiments, the resilient locking piece provided in each connector holding chamber of the holding member is only one in number, but alternatively a pair of resilient pieces, right and left or upper and lower, may be provided to enable connectors to be held more accurately in corresponding connector holding chambers.

Moreover, in the male-female connectors provided with pressure wiring connectors attached to wirings, the male connector housing may be composed of a plurality of connector units similarly to those of the female connectors, where the plurality of connector units are housed in one holding member and the connector units held in the holding member are combined by means of a lever.

As is apparent from the foregoing description, according to the present invention it is possible to manually perform connector coupling without requiring large operating effort and any special tool, since a holding member in which a plurality of connectors are housed and held in position can be brought into engagement by means of a lever. Further, the arrangement is unlikely to cause any impact at the time of coupling connectors, which fact permits the connector assembly to be mounted to an electronic unit or the like without any adverse effect.

According to the present invention, a cover is removably mounted to the holding member at the wire fitting side such that the cover is provided with a hold-down portion which serves to urge connectors held within the holding member against the wall of the holding member. This permits the connectors to be securely held within the connector holding member. Therefore, at the time of male and female connector coupling, connectors can be positively brought into mating engagement without being subject to tilting or jolting.

Especially, when the cover comprises a frame portion formed of a rectangular frame structure and a lid portion connected to the frame portion through a hinge portion, it is possible to visually determine whether connectors are held in position within the connector holding member with the cover mounted to the frame member in position. This permits more precise coupling and connecting of male and female connectors.

The fact that the lever and the pin lockingly engageable with the lever are integrally attached to the holding member eliminates any need for separate members for connector coupling, resulting in decreased number of parts and greater ease of operation. Further, possible increase in cost can be avoided. The lever may be formed of same light-weight resin material as that of the holding member, and this involves no such problem as increased weight or increased space requirement.

While existing connectors may be used as connectors to be held in the holding member, it is also possible to use the connectors for ordinary connecting wires when the holding member is removed. Further, according to the present invention, respective connectors are composed of single connector units and, therefore, larger-current connectors and smaller-current connectors may be used in combination to form composite connectors according to the circuit. This adds to advantage of increased degree of freedom in design.

Although the present invention has been fully described by way of examples with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A combination connector assembly having interengageable male and female connector units adapted for simultaneous engagement in a condition such that plural pairs of connectors are held in position comprising:

first and second holding members removably holding the same number of male and female connector units adjacent each other respectively;

each male connector unit being comprised of a hollow cylindrical frame integrally connected at a first end with a wall of said first holding member with a second end projecting toward said second holding member and adapted to support therein a plurality of male tabs extending through said wall for connection to a printed circuit board;

each female connector unit having a forward end with a recess therein for receiving the second end of a male connector unit therein and holes for receiving said male tabs and a rear end for receiving wire harness connecting means adapted to be electrically connected to said male tabs;

a cover detachably mounted on said second holding member in overlying engagement with said rear end of each female connector unit for holding said female connector units in said second holding member; and cam means connected to said first and second holding members for engaging and drawing said first and second holding members toward each other upon manipulation of said cam means for establishing electrical connection between said male tabs and said wiring harness connecting means simultaneously for said plural pairs of connectors.

2. The combination connector assembly as claimed in claim 1, wherein said cover comprises a frame portion composed of a rectangular frame member and a lid portion connected to the frame portion through a hinge portion, the frame portion including a hold-down portion formed in the interior thereof and projections formed on the outer periphery thereof, the lid portion having locking arms engageable with the projections, one opening of the frame portion being closable by the lid portion.

3. The combination connector assembly as claimed in claim 1, wherein the holding members, the connector housing, and the lever are formed of a light-weight resin material.

* * * * *